US007634883B1

(12) United States Patent
Larson et al.

(10) Patent No.: US 7,634,883 B1
(45) Date of Patent: Dec. 22, 2009

(54) FLOOR LINE TRANSITION JOINT WITH DRIP EDGE AND STUCCO ANCHOR

(75) Inventors: John A. Larson, Parkland, FL (US); Herman Guevara, Bradenton, FL (US)

(73) Assignee: Plastic Components, Inc., Miami, FL (US)

( * ) Notice: Subject to any disclaimer, the term of this patent is extended or adjusted under 35 U.S.C. 154(b) by 483 days.

(21) Appl. No.: 11/475,643

(22) Filed: Jun. 27, 2006

Related U.S. Application Data

(63) Continuation-in-part of application No. 11/324,996, filed on Jan. 3, 2006, now abandoned.

(51) Int. Cl.
*E04F 15/14* (2006.01)
*E04B 1/68* (2006.01)
*E04B 1/343* (2006.01)

(52) U.S. Cl. ..... 52/573.1; 52/396.04; 52/393

(58) Field of Classification Search ..... 52/573.1, 52/396.06, 396.08, 396.04, 395, 393, 345, 52/346, 351, 357, 358, 100, 287.1
See application file for complete search history.

(56) References Cited

U.S. PATENT DOCUMENTS 1,030,044 A * 6/1912 Wittbecker ..... 52/255
1,555,392 A * 9/1925 Tracy et al. ..... 52/273
1,954,847 A * 4/1934 Scholer et al. ..... 52/371
2,298,251 A * 10/1942 Burson ..... 52/27
3,568,391 A * 3/1971 Conway ..... 52/586.2
3,672,108 A * 6/1972 Conway ..... 52/367
4,391,074 A 7/1983 Holsman
4,651,488 A * 3/1987 Nicholas et al. ..... 52/396.02
5,365,713 A * 11/1994 Nicholas et al. ..... 52/573.1
5,477,643 A * 12/1995 Koenig, Jr. ..... 52/100
5,491,936 A * 2/1996 Logan et al. ..... 52/105
5,628,857 A * 5/1997 Baerveldt ..... 156/244.25
5,630,297 A 5/1997 Rutherford
6,293,064 B1 * 9/2001 Larson ..... 52/302.1
6,298,609 B1 10/2001 Bifano et al.
6,374,559 B1 * 4/2002 Rutherford ..... 52/393
6,385,932 B1 5/2002 Melchiori
6,491,468 B1 * 12/2002 Hagen ..... 403/291
6,591,559 B2 * 7/2003 Contreras et al. ..... 52/101
6,893,187 B2 * 5/2005 Lehto et al. ..... 404/47
7,284,357 B2 * 10/2007 McInerney et al. ..... 52/741.41
2006/0150553 A1 * 7/2006 Reyes et al. ..... 52/393

(Continued)

*Primary Examiner*—Richard E Chilcot, Jr.
*Assistant Examiner*—Ryan D Kwiecinski

(57) ABSTRACT

A transition joint comprising: 1) a generally W-shaped central portion including first, second, third, and fourth legs; 2) a first vertical flange extending upwardly form the first leg of the W-shaped central portion; 3) a second vertical flange extending downwardly from the fourth leg of the W-shaped central portion; 4) a first transition zone or land between the first and second legs and a second transition zone between the third and fourth legs; 5) a longitudinal drip edge extending downward from the first transition zone; 6) a T-shaped stucco anchor extending downward from the fourth leg intermediate the second transition zone and the second vertical flange; and 7) a floor line alignment guide extending longitudinally along the first vertical flange. The floor line alignment guide provides accurate positioning of the transition joint with respect to a building in order to create proper clearance for runoff of rainwater and condensation and prevent infiltration of rainwater into the floor line.

11 Claims, 4 Drawing Sheets

U.S. PATENT DOCUMENTS

2006/0277841 A1* 12/2006 Majusiak ..... 52/105
2007/0062137 A1* 3/2007 Maylon ..... 52/367
2007/0130861 A1* 6/2007 Chenier et al. ..... 52/371
2008/0016808 A1* 1/2008 Pilz ..... 52/302.6

* cited by examiner

FLOOR LINE TRANSITION JOINT WITH DRIP EDGE AND STUCCO ANCHOR

This application is a Continuation-In-Part of U.S. patent application Ser. No. 11/324,996 filed Jan. 3, 2006 and now abandoned.

FIELD OF THE INVENTION

The present invention relates to flexible joints for application at the coincidence of two different materials on the exterior of a structure and more particularly to such a flexible joint at the area where a stucco finish or the like is applied over the joint at the second floor line where the block transitions to a different material.

BACKGROUND OF THE INVENTION

In the construction of buildings having exterior finishes of stucco, or the like, is necessary to preserve the integrity of the over-applied stucco finish in the transition area where two dissimilar materials, such as wood and concrete meet. This area of transition is commonly termed the floor line. As a result of the different coefficients of expansion between the concrete portion and the wood portion, a flexible joint is sometimes provided to accommodate movement that occurs between these two portions of the structure. Such flexible joints are commonly referred to as transition joints or control beads. As the floor line typically extends around the entire periphery or a large potion of a structure, the transition joints are typically supplied in long lengths to facilitate rapid covering of the floor line.

A transition joint for use on the exterior wall of a building was disclosed in co-pending U.S. application Ser. No. 11/324,996, which is commonly owned by the assignee of the present invention and the contents of which are incorporated herein in their entirety by reference thereto. The transition joint disclosed in U.S. application Ser. No. 11/324,996 included a first and second vertical flange separated by a generally W-shaped central portion including a first, second, third, and fourth leg. The area between the third and fourth legs included a first transition zone. A longitudinal drip edge was provided extending downward from the first transition zone and a bulbous longitudinal eyebrow was provided extending downward from the fourth leg of the W-shaped central portion. The longitudinal drip edge provided a place for rain or condensation to gather and drop without infiltrating the transition joint. The bulbous longitudinal eyebrow provided a structure for increasing adhesion of stucco to the second vertical flange and to the area underneath the W-shaped central portion.

Although the transition joint described in U.S. application Ser. No. 11/324,996 did include better water shedding abilities and did improve the adhesion of stucco to the second vertical flange, further improvement in the performance of the transition joint are effected by increasing the length of the drip edge, replacing the bulbous eyebrow with a T-shaped member to include more surface area and more convoluted surfaces for adhering to stucco, and the inclusion of a floor line alignment guide for enabling an installer to accurately align the transition joint with the floor line to enable an accurate installation on the building to insure that the transition joint is properly positioned to allow moisture to migrate down and be shed away from the wall.

OBJECTS OF THE INVENTION

It is therefore an object of the present invention to provide a transition joint having a floor line alignment guide to enable accurate alignment of the transition joint with respect to the floor line of a building thereby creating maximum effectiveness for protecting the outer surface of a building against surface fissures from expansion and contraction. As the individual floor line transition joints are supplied in long lengths, such as 10 feet or more, two installers typically work together in installing the joints. The floor line alignment guide speeds up the installation task significantly as it allows the installer at each end to rapidly align the alignment guide with the floor line, thereby reducing guesswork and misalignment of the transition joint.

It is another object of the present invention to provide a transition joint that includes a substantially longer drip edge to improve shedding of water and inhibit infiltration of water into the stucco layer below the joint and also to mask more of the V-channel.

It is a further object of the present invention to provide a transition joint that includes a T-shaped extension that further enhances the adhesion of stucco to the flange and area beneath the joint.

SUMMARY OF THE INVENTION

According to the present invention there is provided a transition joint comprising: 1) a generally W-shaped central portion including first, second, third and fourth legs; 2) a first vertical flange extending upwardly form the first leg of the W-shaped central portion; 3) a second vertical flange extending downwardly from the fourth leg of the W-shaped central portion; 4) a first transition zone or land between the first and second legs and a second transition zone between the third and fourth legs; 5) a longitudinal drip edge of substantial length extending downward from the first transition zone; 6) a T-shaped stucco anchor extending downward from the fourth leg intermediate the second transition zone and the second vertical flange; and 7) a floor line alignment guide extending longitudinally along the first vertical flange. The floor line alignment guide provides accurate positioning of the transition joint with respect to a building in order to create proper clearance for runoff of rainwater and condensation and prevent infiltration of rainwater into the floor line.

| Part Number | Description |
|---|---|
| 80 | transition joint, preferred embodiment |
| 82 | W-shaped central portion |
| 84 | first leg |
| 86 | second leg |
| 88 | third leg |
| 90 | fourth leg |
| 92 | first vertical flange |
| 94 | second vertical flange |
| 96 | first transition zone |
| 98 | second transition zone |
| 100 | longitudinal drip edge |
| 102 | T-shaped stucco anchor |

-continued

| Part Number | Description |
|---|---|
| 104 | floor line alignment guide |
| 106 | front surface of first vertical flange |
| 108 | front surface of second vertical flange |
| 110 | V-shaped grooves |
| 112 | V-channel |
| 114 | extent of stucco on first vertical flange |
| 116 | extent of stucco on second vertical flange |
| 118 | base portion of stucco anchor |
| 120 | end portion of stucco anchor |
| 122 | aperture |
| 124 | aperture |
| 126 | structure or building |
| 128 | framed portion |
| 130 | concrete portion |
| 132 | fastener |
| 134 | floor line |
| 136 | directional arrow showing water path |
| 138 | wood sheathing |
| 140 | framing member |
| 142 | upper stucco layer |
| 144 | lower stucco layer |
| 148 | juncture of first vertical flange and first leg |
| 150 | plane |
| 152 | inner moisture barrier |
| 154 | outer moisture barrier |
| 156 | lath |
| 160 | transition joint. alternative embodiment |
| $d_1$ | distance of floor line alignment guide above juncture |
| $d_2$ | distance of first transition zone beyond second transition zone |
| θ | interior angle of V-channel |

DETAILED DESCRIPTION

Figure 1:
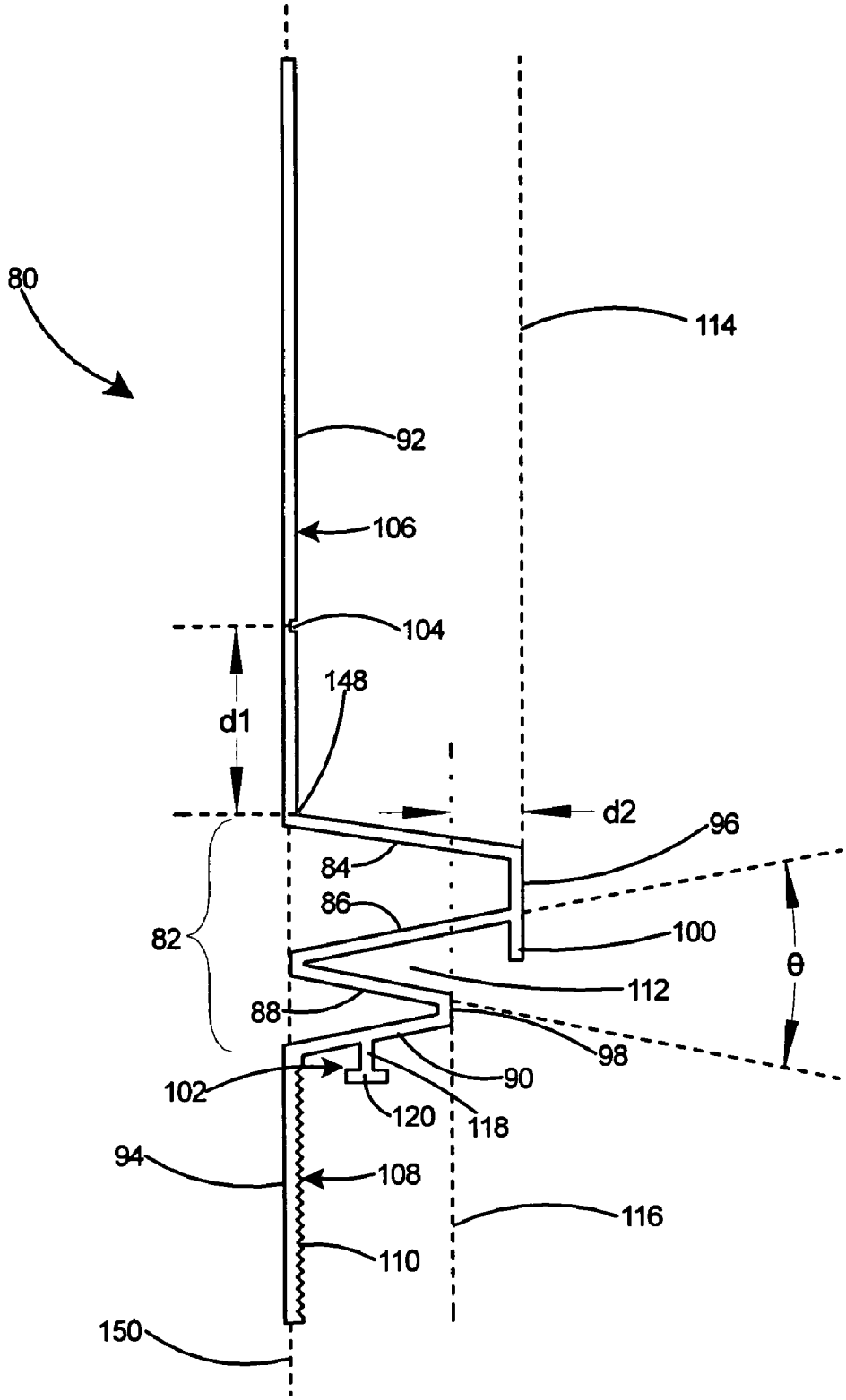
FIG. 1 is a side view of the transition joint of the present invention.

Referring to FIG. 1, the preferred embodiment of a transition joint 80 of the present invention comprises: 1) a generally W-shaped central portion 82 including first, second, third and fourth legs 84, 86, 88 and 90 respectively; 2) a first vertical flange 92 extending upwardly from first leg 84; 3) a second vertical flange 94 extending downwardly from fourth leg 90; 4) a first transition zone 96 between first leg 84 and second leg 86 and a second transition zone 98 between the third leg 88 and fourth leg 90; 5) a longitudinal drip edge 100 of substantial length extending downward from the first transition zone 96; 6) a T-shaped stucco anchor 102 extending downward from the fourth leg 90 intermediate the second transition zone 98 and the second vertical flange 94; and 7) a linear floor line alignment guide 104 extending longitudinally along the first vertical flange 92. Both first 92 and second vertical flanges 94 include front surfaces 106 and 108 respectively, that will be covered with stucco (not shown) after the transition joint 80 has been secured to a building (not shown). The front surfaces 106 and 108 of the first 92 and second 94 vertical flanges may be provided with shallow V-shaped grooves 110, such as shown on second vertical flange 94 in FIG. 1, to increase the available surface area of the flange and thereby improve adhesion of stucco thereto after it is applied over the flange. Preferably the V-shaped grooves 110 have a depth of between 4 and 10 mils (thousandths of an inch) and the front surfaces 106 and 108 include at least 20 V-shaped grooves 110 per inch of the front surface of the respective vertical flange.

Second 88 and third 88 legs of the W-shaped central portion 82 form a V-channel 112 that faces the front of the transition joint 80. First vertical flange 92 is preferably between 2.5 and 4.5 inches high while second vertical flange 94 is preferably between 1.5 and 2.5 inches high. Legs 84, 86, 88, and 90 should be of a length adequate to provide a fixed support for stucco on the order of ⅜ to ⅞ of an inch. Typically, stucco (not shown) is spread across the front surface 106 of first vertical flange 92 to the extent indicated by dashed line 114 and stucco is spread across the front surface 108 of second vertical flange 94 to the extent indicated by dashed line 116. Since the thickness of stucco applied over the framed portion is generally greater than that applied over the concrete portion, legs 84 and 86 are longer than legs 88 and 90 to provide surfaces that are adequate to support the varying stucco thicknesses. Legs 84 and 86, being longer than legs 88 and 90, direct rain and condensation runoff beyond legs 88 and 90 and therefore beyond the lower stucco layer, which will be at expected extent 116.

The T-shaped stucco anchor 102 includes a base portion 118 that extends a substantial distance downward from the fourth leg 90 and an end portion 120 that is generally perpendicular to the base portion 118. The base portion 118 and end portion 120 provide substantial surface area for stucco (not shown) to adhere to once it is spread along the front surface 108 of the second vertical flange 94. The end portion 120 is preferably at least 0.10 inch in length.

Figure 2:
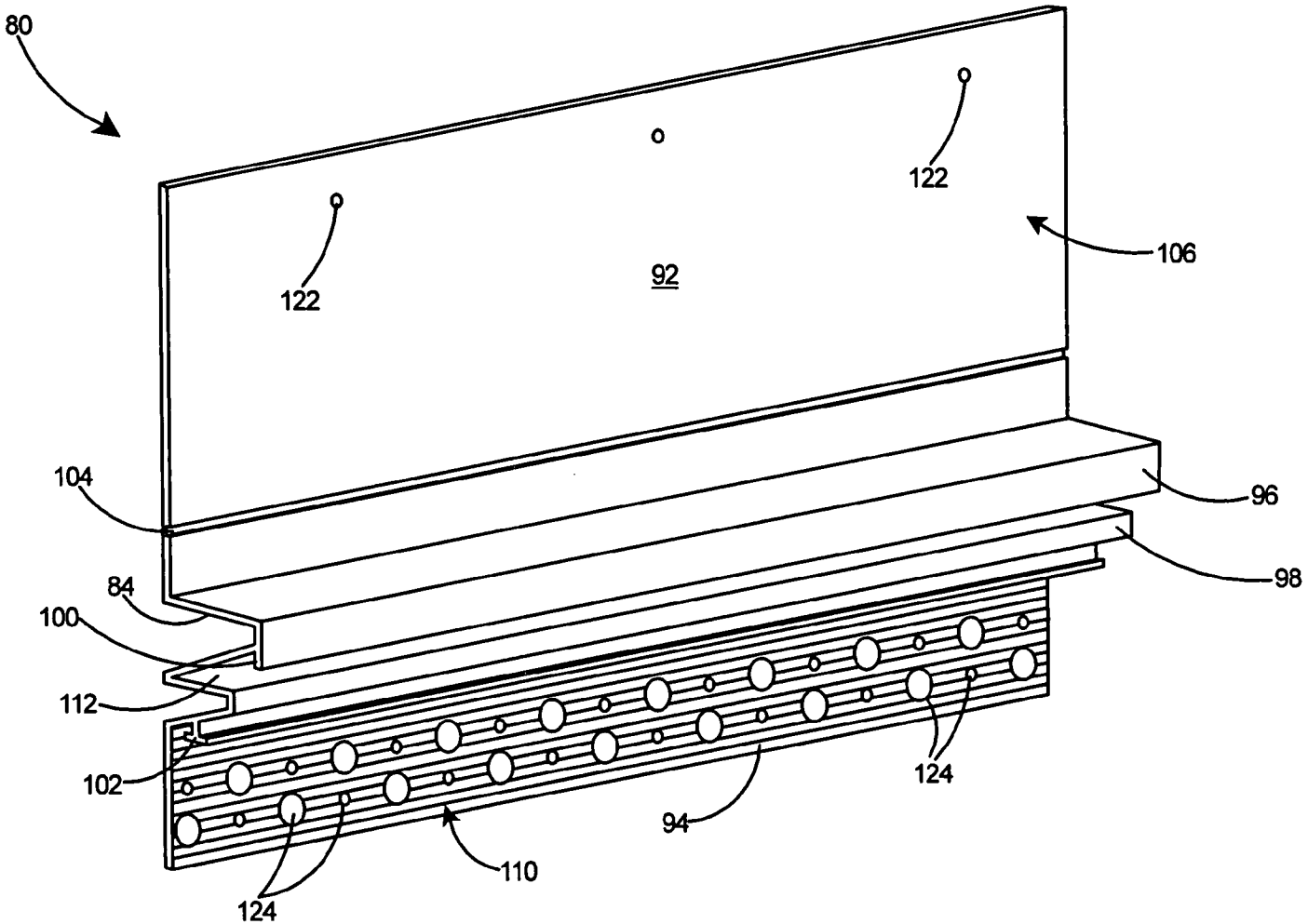
FIG. 2 is a perspective view of the transition joint of the present invention.

By providing a longitudinal drip edge 100 of substantial length, as shown in FIG. 1, any water or condensation runoff from the upper stucco layer will be carried a substantial distance outwards and away from the lower stucco layer. The V-channel 112 of the transition joint 80 of the present invention is a narrow V-shape as a result of the sharp angles of the second leg 86 with respect to the third leg 88. As a result of the narrow V-channel 112 and the extended length of the drip edge 100, the gap between the upper and lower stucco layers is minimized and substantially hidden from view, thereby improving the visual appearance of the exterior stucco to the observer. As shown in FIG. 2, as a result of the extended length longitudinal drip edge 100 the V-channel 112 is substantially hidden from view.

With reference to FIG. 2, the transition joint 80 further may include apertures 122 for accommodating fasteners (not shown) such as nails or screws for securing the transition joint to a building (not shown). Second vertical flange 94 may also include apertures 124 along its length to allow, during application of stucco, stucco permeation or flow through to enable better adhesion of stucco to the second vertical flange 94 and to the surface of the structure the transition joint 80 is applied to. The floor line alignment guide 104 is linear, highly visible, and extends longitudinally along the first vertical flange 92. According to the present invention, the floor line alignment guide 104 can be a groove formed in the front surface 106 of the first vertical flange 92 or a raised area formed on the front surface 106 of the first vertical flange 92. The floor line alignment guide 104 can also be a visible mark on the first vertical flange 92, with the color of the mark of a color that is in high contrast to the color of the first vertical flange 92.

Figure 3:
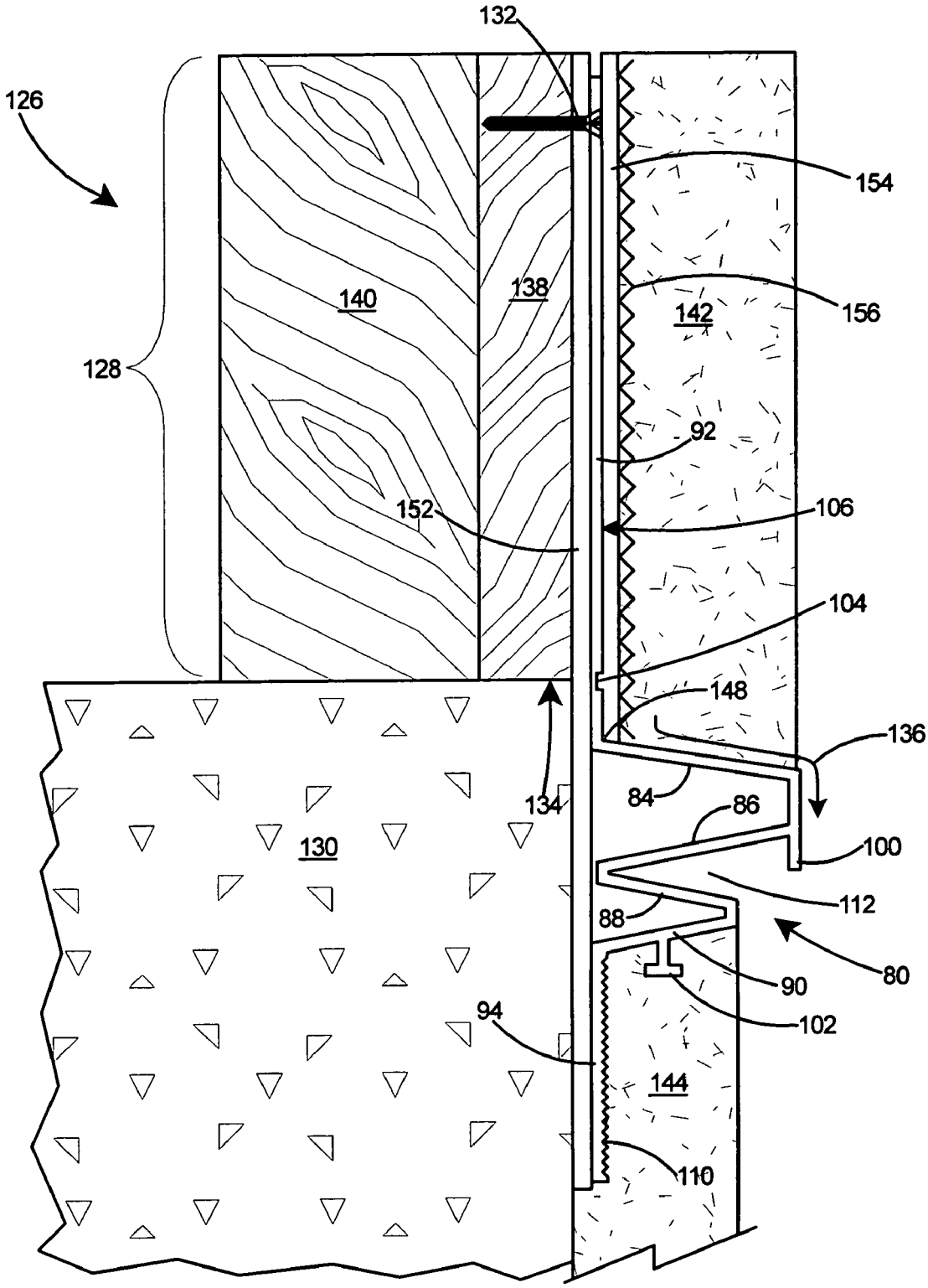
FIG. 3 is a sectional view of an installation of the transition joint of the present invention.
Figure 4:
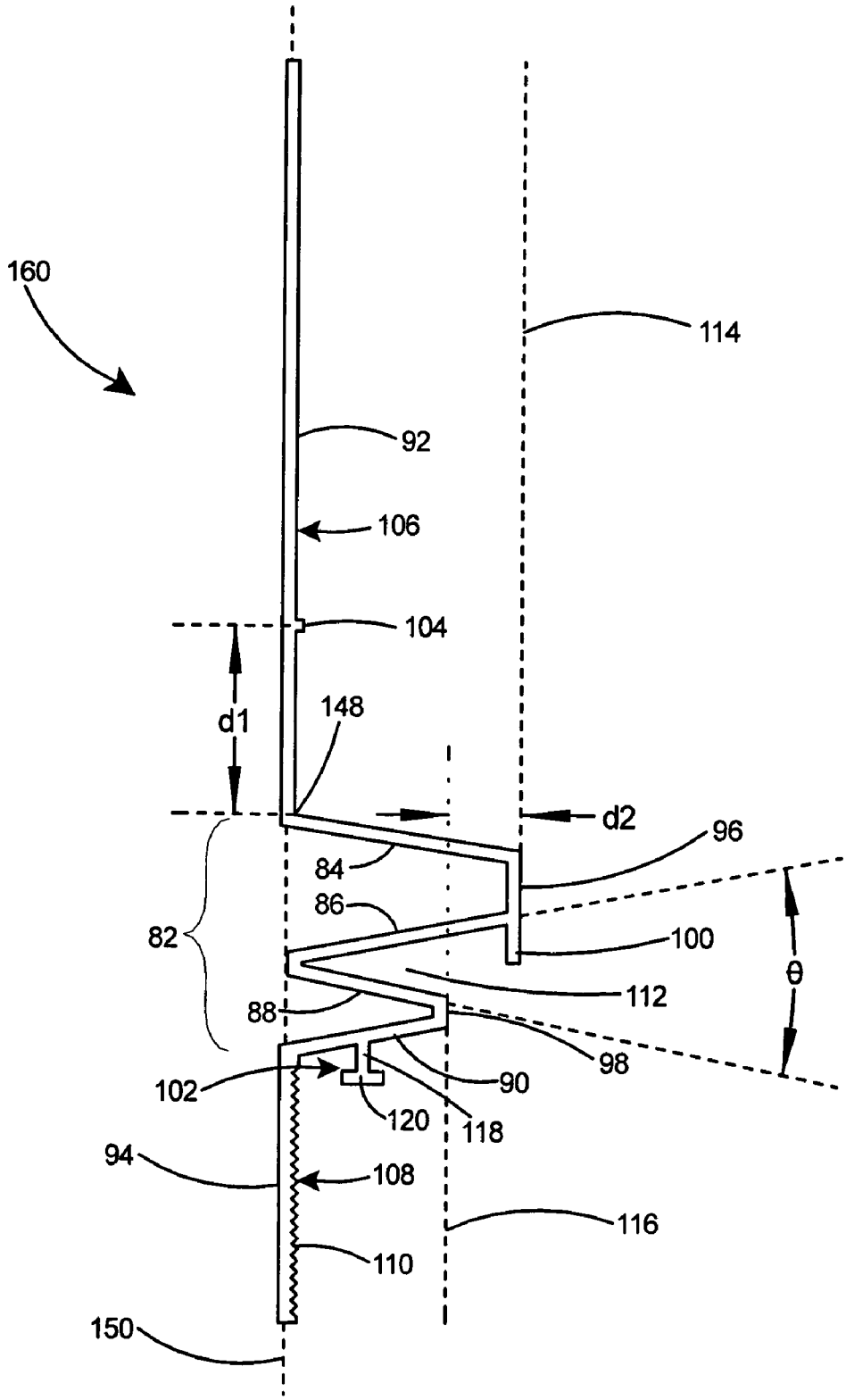
FIG. 4 is a side view of an alternate embodiment of the transition joint of the present invention.

With reference to FIG. 3, transition joint 80 is shown installed on a structure 126 including a framed or wood portion 128 and a concrete portion 130. Transition joint 80 is secured to the framed portion 128 of a structure 126 to which stucco is to be applied using fasteners 132 such as nails, staples, or screws such as the one shown in the figure. In such an installation second vertical flange 94 extends over the concrete portion 130 of the structure such that first vertical flange 92 extends across the floor line 134 at the juncture of framed portion 128 and concrete portion 130.

Normal variation in temperature causes significant daily expansion and contraction of building structures. During daily changes in temperature, the framed portion of a building will expand and contract at a different rate than the concrete portion as a result of their different materials of construction.

The joint between the framed portion and the concrete portion is typically referred to as the floor line. Transition joints are therefore installed on a structure to provide a flexible joint that is capable of flexing vertically to absorb the differences in expansion and contraction of the two portions of the structure. One critical aspect of installing a transition joint is achieving the proper alignment of the transition joint with respect to the floor line. Misalignment of the transition joint with respect to the floor line is a frequent mistake made by installers and can lead to water or condensation leaking into the floor line of the structure.

With reference to FIG. 3, the floor line alignment guide 104 therefore provides a convenient and necessary visual reference for insuring that the transition joint 80 is properly installed. As shown in FIG. 3, the floor line alignment guide 104 extending longitudinally along the transition joint 80 is aligned exactly with the floor line 134 of the structure 126. This insures that any water runoff, signified by directional arrow 136, is directed away from the structure 126 and does not seep into the floor line 134 where it would be absorbed by the wood structures present there, such as the wood sheathing 138 or framing member 140. Therefore any rainwater or condensation that is absorbed into upper stucco layer 142 will drain downward to first leg 84 and thence will flow out of upper stucco layer 142 and along drip edge 100 from where it will drip away from lower stucco layer 144 and concrete portion 130. Preferably the floor line alignment guide 104 is at least 0.5-inch distance above the juncture 148 of the first vertical flange and the first leg 84. This distance, which is depicted as distance $d_1$ in FIG. 1, is a critical distance for ensuring that the transition joint 80 is properly installed to force any rainwater or condensation to drain away from the floor line 134. With further reference to FIG. 3, an inner moisture barrier 152 is typically installed between the wood sheathing 138 and the transition joint 80, an outer moisture barrier 154 is typically installed on the front surface 106 of first vertical flange 92, and lath 156 is typically installed against the outer moisture barrier 154 prior to applying the stucco layer 142.

With reference to FIG. 1, leg 84 of transition joint 80 preferably slopes downward at an angle greater than about 3 degrees from horizontal or more than 93 degrees from first vertical flange 92 to further assist with removal of unwanted water or condensation from first leg 84. To reduce the width of V-channel 112 and make it less visible to the observer, second leg 86 is preferably at an angle θ of 25 degrees or less with respect to third leg 88. This narrow angle minimizes the interior angle of the V-channel 112 and reduces its visibility to the observer in the final installation on a structure.

As shown in FIG. 1, the first vertical flange 92 and second vertical flange 94 are planar with respect to one another and reside in plane 150. The first transition zone 96 is a substantial distance, shown as distance $d_2$ in FIG. 1, farther from plane 150 than the second transition zone 98 is, thereby insuring that any water falling from drip edge 100 will fall clear of the second transition zone 98 and extent of stucco 116. Preferably distance $d_1$ is at least 0.25 inch.

While transition joint 80 can be manufactured from a wide variety of materials including metals such as aluminum or copper, it is preferred for purposes of cost and ease of manufacture that it be fabricated from an extrudable polymeric material such as polyvinyl chloride or the like.

As the invention has been described, it will be apparent to those skilled in the art that the same may be varied in many ways without departing from the spirit and scope of the invention. Any and all such modifications are intended to be included within the scope of the appended claims.

What is claimed is:

1. A transition joint for covering the floor line of a building comprising:

a generally W-shaped central portion including first, second, third and fourth legs;

a first vertical flange extending upwardly from said first leg of said W-shaped central portion;

a second vertical flange extending downwardly from said fourth leg of said W-shaped central portion, said second vertical flange including a front surface;

said first and second vertical flanges residing in the same plane;

a first transition zone between said first leg and said second leg, said first transition zone a planar segment;

a drip edge extending downward from said first transition zone, said drip edge a planar segment coplanar with said first transition zone;

a T-shaped stucco anchor extending downward from said fourth leg;

V-shaped grooves in said front surface of said second vertical flange; and a floor line alignment guide extending longitudinally along said first vertical flange, said floor alignment guide providing a visual reference line for accurately aligning said transition joint with respect to said floor line.

2. The transition joint of claim 1 including a second transition zone between said third and said fourth leg.

3. The transition joint of claim 2 wherein said first transition zone is a substantial distance farther from said planar vertical flanges than said second transition zone.

4. The transition joint of claim 2 wherein said first transition zone extends at least 0.25 inch farther from said planar vertical flanges than said second transition zone.

5. The transition joint of claim 1 including a juncture of said first vertical flange and said first leg; and said floor line alignment guide extending longitudinally along said first vertical flange is at least 0.5 inch above said juncture of said first vertical flange and said first leg, whereby said floor line alignment guide when aligned with said floor line positions said drip edge a substantial distance below said floor line.

6. The transition joint of claim 1 wherein said transition joint is formed of plastic.

7. The transition joint of claim 1 including mounting apertures in said first vertical flange; and apertures in said second vertical flange, whereby said apertures in said second vertical flange enable permeation of stucco through said second vertical flange to increase adhesion of the stucco to said second vertical flange.

8. The transition joint of claim 1 including a V-channel between said second leg and said third leg; and said second leg is at an angle of 25 degrees or less with respect to said third leg.

9. The transition joint of claim 1 wherein said floor line alignment guide is a groove formed in said first vertical flange of said transition joint.

10. The transition joint of claim 1 wherein said floor line alignment guide is a raised area formed in said first vertical flange of said transition joint.

11. The transition joint of claim 1 wherein said first vertical flange is of a first color, said floor line alignment guide is a mark on said first vertical flange of said transition joint; and said mark is of a color contrasting the first color of said first vertical flange.

* * * * *